US006790255B2

(12) United States Patent
Hashimoto et al.

(10) Patent No.: US 6,790,255 B2
(45) Date of Patent: Sep. 14, 2004

(54) MOVING-HEARTH HEATING FURNACE AND METHOD FOR MAKING REDUCED METAL AGGLOMERATES

(75) Inventors: Sumito Hashimoto, Kobe (JP); Hiroshi Uemura, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 160 days.

(21) Appl. No.: 10/193,218

(22) Filed: Jul. 12, 2002

(65) Prior Publication Data

US 2003/0015064 A1 Jan. 23, 2003

(30) Foreign Application Priority Data

Jul. 17, 2001 (JP) ..... 2001-216862

(51) Int. Cl.[7] ..... C21B 13/08
(52) U.S. Cl. ..... 75/484; 266/177; 432/138
(58) Field of Search ..... 75/484; 266/177; 432/138

(56) References Cited

U.S. PATENT DOCUMENTS

| | | | | |
|---|---|---|---|---|
| 3,443,931 A | | 5/1969 | Beggs et al. | |
| 4,363,653 A | * | 12/1982 | Granstrom | 75/10.15 |
| 5,989,019 A | | 11/1999 | Nishimura et al. | |
| 6,063,156 A | | 5/2000 | Negami et al. | |
| 6,129,777 A | | 10/2000 | Fuji et al. | |
| 6,139,314 A | * | 10/2000 | De Marchi et al. | 432/138 |
| 6,149,709 A | | 11/2000 | Uragami et al. | |
| 6,152,983 A | | 11/2000 | Kamijo et al. | |
| 6,241,803 B1 | | 6/2001 | Fuji | |
| 6,254,665 B1 | | 7/2001 | Matsushita et al. | |
| 6,258,149 B1 | | 7/2001 | Sugiyama et al. | |
| 6,296,479 B1 | | 10/2001 | Nishimura et al. | |
| 6,319,302 B1 | | 11/2001 | Harada | |
| 6,334,883 B1 | | 1/2002 | Takenaka et al. | |
| 6,368,379 B1 | | 4/2002 | Tateishi et al. | |

OTHER PUBLICATIONS

Patent Abstracts of Japan, JP 02–013786, Jan. 18, 1990.

* cited by examiner

*Primary Examiner*—Melvyn Andrews
(74) *Attorney, Agent, or Firm*—Oblon, Spivak, McClelland, Maier & Neustadt, P.C.

(57) ABSTRACT

An annular rail 6 is fixed on the lower surface of a moving hearth 2, and the rail 6 is supported from below by support rollers 7 provided with elevating devices 8. The moving hearth 2 is continuously or intermittently moved downward by the elevating devices 8 depending on the thickness of a metal oxide layer formed by the deposition of powder of metal oxide agglomerates mixed into the furnace together with the metal oxide agglomerates so that a gap is provided between the surface of the metal oxide layer and the edge of the blade of a discharge screw 4 during operation. A means for preventing the formation of a metal plate and a method for operating the same are provided instead of a means and method including the vertical movement of a discharger for reduced metal, so that the maintenance work can be significantly reduced in a moving-hearth heating furnace, in which metal oxide agglomerates containing a carbonaceous material is placed on a moving hearth, the metal oxide agglomerates are heated and reduced to form reduced metal agglomerates, and the reduced metal agglomerates are discharged from the furnace by a discharger to produce reduced metal.

7 Claims, 3 Drawing Sheets

MOVING-HEARTH HEATING FURNACE AND METHOD FOR MAKING REDUCED METAL AGGLOMERATES

BACKGROUND OF THE INVENTION

1. Field of the Invention

The present invention relates to a technique for producing reduced metal agglomerates by heating and reducing metal oxide agglomerates containing a carbonaceous material using a moving-hearth heating furnace. Examples of the metal oxide agglomerates include agglomerates of a raw material containing iron oxides, nickel oxide, chromium oxide, cobalt oxide, or a mixture of these substances.

2. Description of the Related Art

As a method for making reduced iron, the Midrex process is well known. In this process, a reducing gas formed from natural gas is blown into a shaft furnace through a tuyere so that the shaft furnace is kept in a reducing atmosphere, and iron ore or iron oxide pellets charged in the furnace are reduced by being brought into contact with the reducing gas, and thereby reduced iron is obtained.

However, in this method, since natural gas, which is an expensive fuel, must be used to form the reducing gas and a large amount of natural gas must be supplied, an increase in production costs is inevitable.

Under these circumstances, recently, processes for producing reduced iron using relatively inexpensive coal instead of natural gas as the reducing material have been receiving attention again. For example, U.S. Pat. No. 3,443,931 discloses a process in which fine ore and a carbonaceous material (e.g., coal) are mixed together and pelletized, followed by reducing by heating in a high-temperature atmosphere, to produce reduced iron. In this process, dried iron oxide pellets containing a carbonaceous material are fed into a rotary hearth furnace at a given thickness, and the mixture is heated by radiant heat in the furnace while being moved in the furnace, and thereby the iron oxide pellets are reduced by the carbonaceous material. The reduced iron oxide pellets are radiation-cooled by a cooling plate, referred to as a chill plate, in the radiation cooling zone, and are then scraped away from the moving hearth by a discharge screw of a discharger and are discharged from the furnace.

In addition to the fact that the reducing material is coal-based, this process is advantageous over the Midrex process in that, for example, fine ore can be directly used, the reduction rate can be increased, and the carbon content in the product can be adjusted.

Although the process has the advantages described above, powder, which is generated from the iron oxide pellets due to various factors, such as rolling, friction, or dropping impact when the pellets are fed into the furnace, is also fed into the furnace together with the pellets. The fed powder is deposited on the moving hearth which rotates to form an iron oxide powder layer. Since the iron oxide powder layer includes the carbonaceous material, it is reduced in the same manner as the iron oxide pellets, and thus a reduced iron powder layer is formed. Although a portion of the reduced iron powder is discharged from the furnace by the discharger together with the reduced iron pellets, the other portion of the reduced iron powder remains on the moving hearth and is pressed against the surface of the moving hearth by the discharger. The reduced iron powder pressed against the surface of the moving hearth is deposited on the surface of the moving hearth without being reoxidized because of its denseness. Reduced iron powder is further added as the rotary hearth rotates and reduced iron powder is gradually integrated into the previously deposited reduced iron powder to form a reduced iron layer in the shape of a large plate. The plate-shaped reduced iron layer (hereinafter referred to as an "iron plate") may be scraped by the edge of the blade of the discharge screw and the separated reduced iron may be wound around the discharge screw or may prevent the reduced iron from being discharged because of clogging of the discharge port, giving rise to problems, such as shutdown.

A depression exists on the surface of the moving hearth after the iron plate is scraped off, and the charged agglomerates enter the depression. As a result, it is not possible to charge the agglomerates at a given thickness, the agglomerates cannot be heated homogeneously, and the rate of reduction varies for each agglomerate, resulting in a degradation in quality of the reduced iron.

Under these circumstances, in order to prevent the formation of the iron plate, the applicant of the present invention has carried out thorough research on the formation mechanism of the iron plate, and has completed an invention in Japanese Patent No. 3075721 (Prior Art 1). The above invention is characterized in that the operation is carried out by continuously or intermittently moving a discharger upward from the surface of a moving hearth, depending on the thickness of the iron oxide layer, so that a gap is provided between the surface of the moving hearth and the discharger. In the above invention, although the iron oxide powder layer formed on the moving hearth by powder mixed into the furnace together with the iron oxide pellets is reduced to form a reduced iron powder layer, the reduced iron powder layer is not densified because it, is not pressed by a discharger, such as a discharge screw, and the reduced iron powder layer is reoxidized during passing through the furnace again to form an iron oxide layer. Therefore, an iron plate is not formed.

As the discharger used in prior art 1 described above, a discharge screw having a schematic structure shown in FIG. 3 is generally employed.

That is, as shown in FIG. 3, a through-hole 26 is provided on the side wall of a moving-hearth furnace, and a screw axis 4 of the discharge screw is extended to the outside of the furnace and is supported by a screw axis bearing 24 arranged outside of the furnace. The screw axis 4 is revolved by a drive device for discharger 28 arranged outside of the furnace through a chain or the like. Since the discharge screw must be moved vertically during operation, an elevating device 22 for moving the screw bearing 24 vertically is provided, and an expansion joint 23, functioning as a gas-sealing means, which is made of metal is also provided so as to prevent air from entering the furnace through the gap between the through-hole 26 and the screw axis 4 and to prevent furnace gas from leaking out of the furnace.

However, in the metal expansion joint 23 as shown in FIG. 3, in general, since the amount of expansion in a direction perpendicular to the axial direction is smaller than the amount of expansion in the axial direction, it is difficult to secure the amount of vertical movement of the screw axis 4 required for the operation. Furthermore, as vertical movement is repeated, the expansion joint 23 is subjected to repeated elastic deformation in the direction perpendicular to the axial direction, and damage, such as cracks, due to metal fatigue easily occurs. When such damage occurs, in order to replace the expansion joint 23, the screw bearing 24 section must be disassembled by halting the operation, and thus the maintenance work is troublesome.

Although the case in which reduced iron agglomerates are produced using iron oxide agglomerates containing the carbonaceous material as raw materials by the rotary hearth furnace has been described above, even when raw materials including nonferrous metal oxides, such as nickel oxide, chromium oxide, and cobalt oxide, instead of iron oxides, are used as raw materials, it is possible to produce reduced metal by metallizing these oxides. However, in such a case, since a metal plate similar to the iron plate described above is also formed on the surface of the hearth, the formation of the metal plate must be prevented, thus giving rise to the same problems as those described above.

SUMMARY OF THE INVENTION

Accordingly, the objects of the present invention are to provide a moving-hearth furnace for producing reduced metal having a means for preventing a metal plate from being formed other than moving a discharger (discharge screw) vertically, so that the maintenance work can be significantly reduced, and to provide a method for operating the same.

In the present invention, a moving-hearth heating furnace includes a moving hearth which moves with a metal oxide-containing material being placed thereon, a heating furnace for heating the metal oxide-containing material to produce a heat-treated material while the moving hearth is moving in the heating furnace, and a discharger for discharging the heat-treated material from the heating furnace, wherein the moving hearth is movable vertically.

Further, in the present invention, the moving-hearth heating furnace includes an elevating device for moving the moving hearth vertically, the elevating device being provided on a supporting section for supporting the moving hearth.

The moving-hearth heating furnace can further comprise a seal plate provided around the entire lower section of the moving hearth and a water-sealing trough fixed on a side wall of the heating furnace, wherein the length of the seal plate and the depth and fixing position of the water-sealing trough are determined so that the lower end of the seal plate is kept being immersed in water in the water-sealing trough when the moving hearth is moved upward to the upper limit.

The moving-hearth heating furnace can further comprise a columnar partition provided on the moving hearth and a roof having a recess, wherein the top of the columnar partition is inserted into the recess and the height of the columnar partition and the depth of the recess are determined so that the top of the columnar partition does not come out of the recess when the moving hearth is moved downward to the lower limit.

In the present invention, a method for making reduced metal agglomerates includes the steps of feeding metal oxide agglomerates containing a carbonaceous material onto a moving hearth which moves in a heating furnace, heating and reducing the metal oxide agglomerates to produce reduced metal agglomerates while the moving hearth is moving in the heating furnace, and discharging the reduced metal agglomerates from the heating furnace by a discharger provided above and in close proximity to the moving hearth in the heating furnace. The moving hearth is continuously or intermittently moved vertically depending on the thickness of a metal oxide layer formed by the deposition of powder of the metal oxide agglomerates mixed into the heating furnace together with the metal oxide agglomerates so that a gap is provided between the surface of the metal oxide layer and the discharger during operation.

In the method for making reduced metal agglomerates, the rate of moving the moving hearth downward continuously or the amount of moving the moving hearth downward intermittently can be adjusted depending on the amount of powder of the iron oxide agglomerates entering the heating furnace In the method for making reduced metal agglomerates, the rate of moving said moving hearth downward can be adjusted so that a gap corresponding to three-fourths or less of the average diameter of the agglomerates is provided between the edge of a blade of a discharge screw of the discharger and the surface of the moving hearth or the iron oxide layer.

In accordance with the present invention, since metallic powder generated by the reduction of powder of metal oxide agglomerates is not compressed into the surface of the moving hearth, the formation of a metal plate can be prevented. In addition, the maintenance workload for the sealing mechanism of the discharger can be significantly reduced, continuous operation is enabled for a longer period of time, and reduced metal having a high metallization rate can be obtained stably.

DESCRIPTION OF THE PREFERRED EMBODIMENTS

Figure 1:
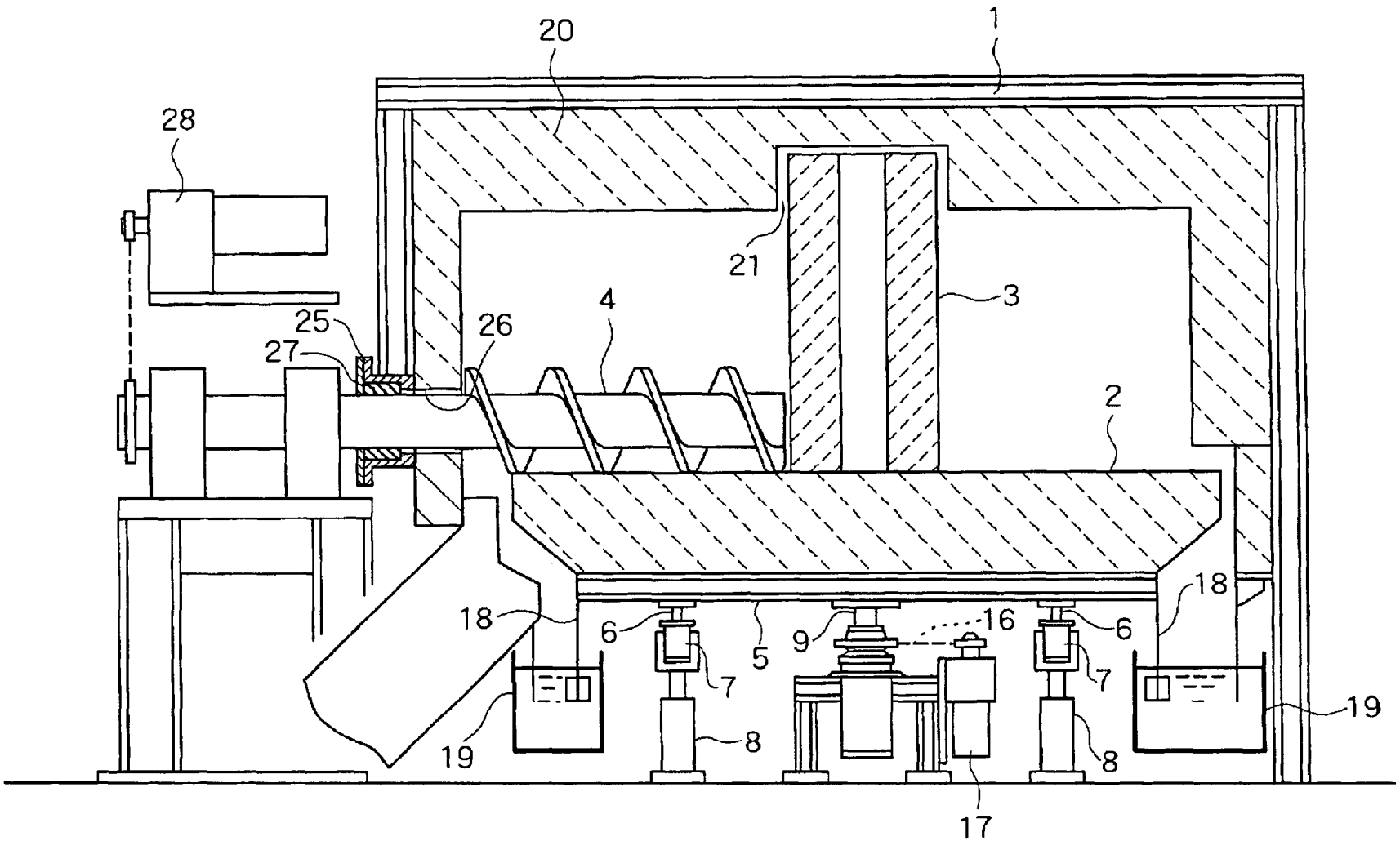
FIG. 1 is a sectional view of a rotary hearth furnace according to an embodiment of the present invention.
Figure 2:
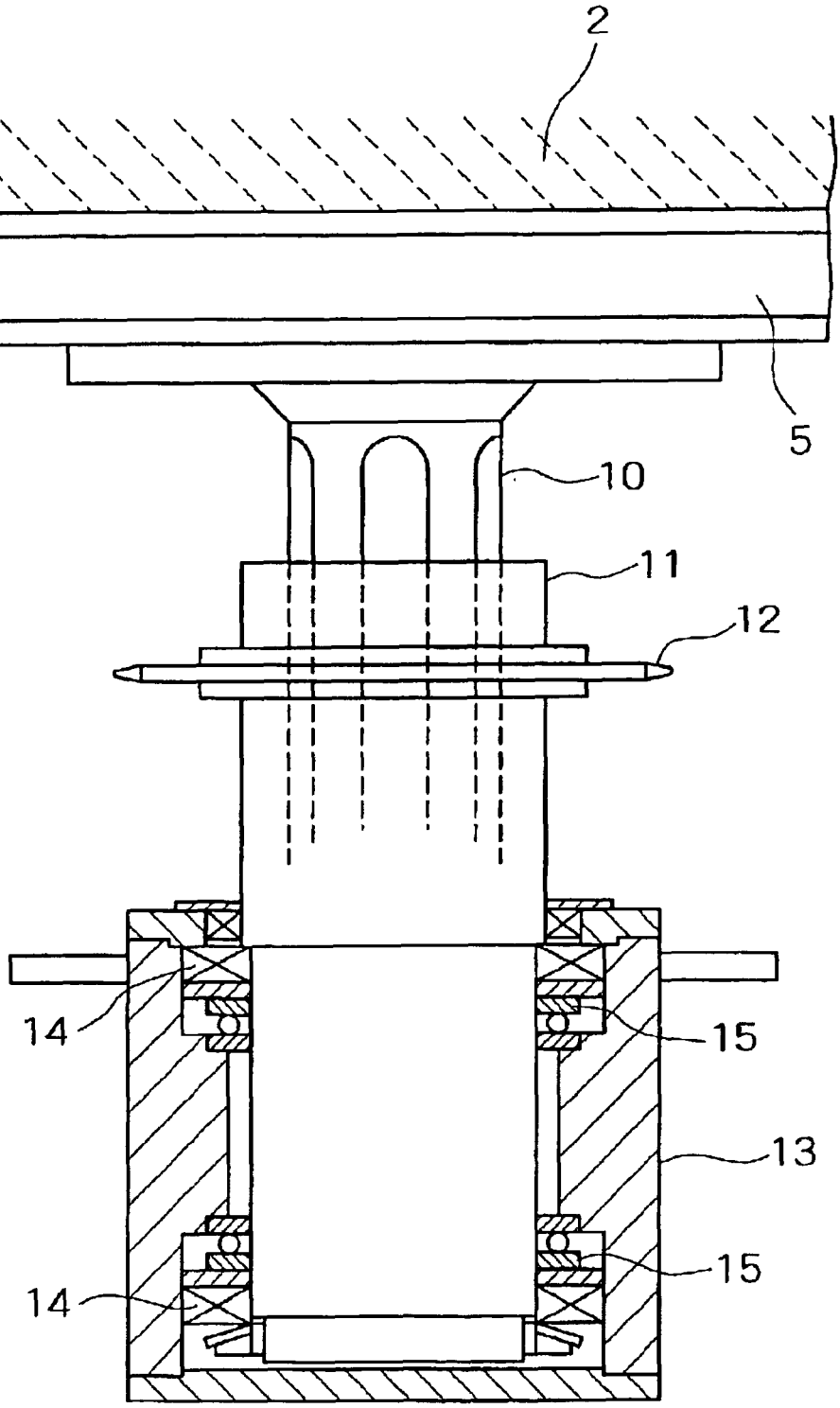
FIG. 2 is a schematic diagram showing an elevating device provided on a supporting section of a rotary hearth of the rotary hearth furnace according to the embodiment of the present invention.
Figure 3:
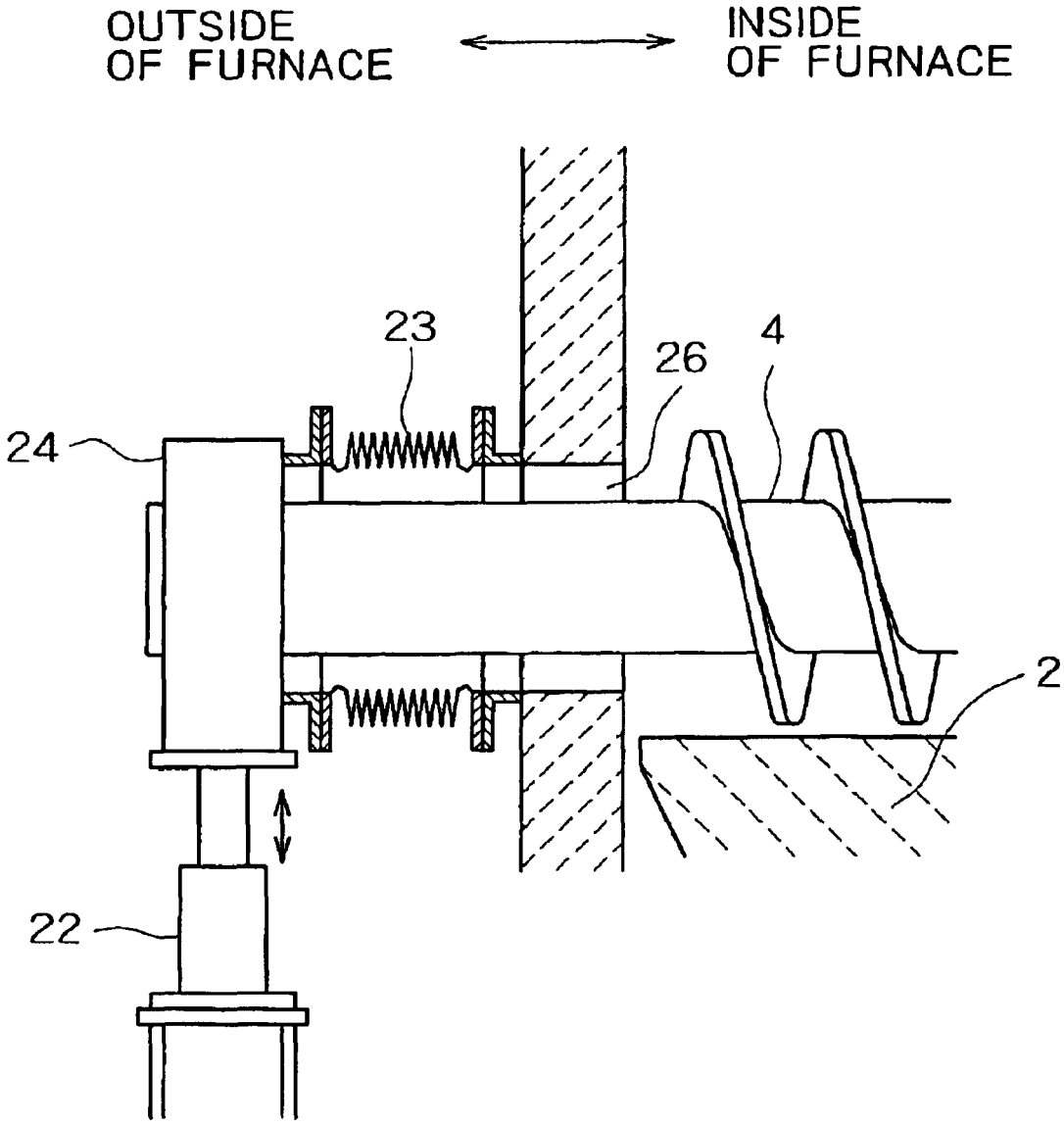
FIG. 3 is a sectional view which schematically shows the structure of a discharge screw used in Prior Art 1.

FIGS. 1 and 2 show an embodiment of the present invention in the case in which reduced iron, as the reduced metal, is produced using a rotary hearth furnace, as the moving-hearth heating furnace, and using iron oxide agglomerates as the metal oxide agglomerates.

As shown in FIG. 1, the rotary hearth furnace includes a furnace shell 1 and a rotary hearth 2. The furnace shell 1 does not have the commonly used annular structure including an outer wall, an inner wall, and a roof linking them, as in the conventional method, but has a cap-shaped structure including only an outer wall and a roof, without an inner wall. The rotary hearth 2 does not have the commonly used doughnut-shaped structure in which the central section is an empty space, but has a disk-shaped structure having a columnar partition 3 provided in the center and extending upward. The reason for employing such a structure is that, as will be described above, a gas sealing means for an inner wall section is not required because an inner wall is eliminated, thus significantly reducing the maintenance work.

A metallic support frame 5 is disposed in contact with the lower surface of the rotary hearth 2 in order to support the weight of the rotary hearth 2 composed of a refractory material, and so on. An annular rail 6, which is concentric with the axis of the rotary hearth 2, is fixed upside down on the lower surface of the support frame 5. A plurality of support rollers 7 which support the rail 6 from below are placed on the same circumference as that of the rail 6. Each support roller 7 is provided with an elevating device 8. A mechanically or electrically synchronizing mechanism is provided between all the provided elevating devices 8. By operating the elevating devices 8, the plurality of support rollers 7 are moved vertically at the same time, and the rotary hearth 2 can be elevated via the rail 6 supported by the support rollers 7 and the support frame 5 while the surface of the rotary hearth 2 is kept horizontal.

Reference numeral 9 represents a rotating axis for rotating the rotary hearth 2 horizontally. The rotating axis 9 is rotated by a driving device 17. As shown in FIG. 2 in detail, the rotating axis 9 includes an internal cylinder 10 of the rotating axis and an external cylinder 11 of the rotating axis. The internal cylinder 10 of the rotating axis is joined to the lower surface of the support frame 5 so as to correspond to the axis of rotation of the rotary hearth 2. The external cylinder 11 is rotatably inserted into a support device 13 fixed on the ground (floor) with radial bearings 14 and thrust bearings 15 therebetween. The internal cylinder 10 and the external cylinder 11 are connected to each other by a spline mechanism, and the internal cylinder 10 moves smoothly in relation to the external cylinder 11. Therefore, since the internal cylinder 10 moves vertically and contracts in conjunction with the vertical movement by the elevating devices 8 provided on the individual support rollers 7, the rotary hearth 2 is not prevented from being moved vertically. A sprocket 12 is mounted on the external cylinder 11. The sprocket 12 is connected to a driving device 17 including a motor and a speed reducer via a chain 16. Therefore, by using the rotating axis 9 and the driving device 17, it is possible to move the rotary hearth vertically while rotating the rotary hearth at a desired rotational speed.

A seal plate 18 is provided around the entire lower section of the rotary hearth 2 like a headband. As the rotary hearth 2 is moved vertically, the seal plate 18 is also moved vertically. The seal plate 18 displays a gas-sealing function in a state in which at least the lower end thereof is immersed in water filled in a water-sealing trough 19. The water-sealing trough 19 is usually fixed on the side wall of the furnace, etc. The length of the seal plate 18 and the depth and fixing position of the water-sealing trough are determined so that the lower end of the seal plate 18 is kept being immersed in water in order to ensure water sealing suitable for the furnace pressure even when the rotary hearth 2 is moved upward to the upper limit and so that the lower end of the seal plate 18 does not hit the bottom of the water-sealing trough 19 even when the rotary hearth 2 is moved downward to the lower limit.

As the rotary hearth 2 is moved vertically, the columnar partition 3 provided on the rotary hearth 2 is also moved vertically. The top of the columnar partition 3 is inserted into a recess 21 which is provided in the center of the roof 20 of the furnace shell 1. The height of the columnar partition 3 and the depth of the recess 21 are determined so that the top of the columnar partition 3 does not come out of the recess 21 even when the rotary hearth 2 is moved downward to the lower limit and so that the top of the columnar partition 3 does not hit the bottom of the recess 21 even when the rotary hearth 2 is moved upward to the upper limit. Additionally, the internal diameter of the recess 21 is slightly larger than the external diameter of the columnar partition 3 so that the rotation and vertical movement of the columnar partition 3 are not prevented and a large amount of furnace gas does not flow into the recess 21. By using such a combination of the columnar partition 3 and the recess 21, it is possible to direct the gas flow in the reduction furnace in the moving direction (or in a direction opposite to the moving direction) of the agglomerates, the same as the case when a furnace shell 1 provided with an inner wall, which is a commonly used structure in the conventional method, is used, and it is also possible to maintain high energy efficiency. Additionally, a gas-sealing means, which is required for the inner wall section in the conventional method, is not required. By eliminating the gas-sealing means, the maintenance work is not required in the center of the furnace, and thus the maintenance workload is significantly reduced.

By using the rotary hearth furnace 1 described above, since only the rotary hearth 2 is moved vertically and the relative position between the furnace shell 1 and a screw axis 4 is not changed, a sealing mechanism having a simple structure can be employed between the screw axis 4 and a screw axis through-hole 24. For example, as shown in FIG. 1, by inserting a gland packing 27 into a gap between the screw axis 4 and the screw axis through-hole 24, the screw axis 4 is allowed to slide horizontally and gas sealing can be performed without fail. The gland packing can also be replaced easily, and thus the maintenance workload is significantly reduced.

By using the rotary hearth furnace described above, when the rotary hearth 2 is continuously or intermittently moved downward, depending on the thickness of a metal oxide layer formed on the rotary hearth 2 by the deposition of powder of metal oxide agglomerates mixed into the furnace together with the metal oxide agglomerates, so that a gap is provided between the surface of the metal oxide layer and the edge of the blade of the discharge screw 4 during operation, the powder of agglomerates is not compressed into the surface of the rotary hearth 2 by the edge of the blade of the discharge screw 4, and thus it is possible to prevent an iron plate from being formed on the rotary hearth 2.

Alternatively, instead of providing a gap between the surface of the iron oxide layer and the edge of the blade of the discharge screw 4, even if the edge of the blade of the discharge screw is in contact with powder of iron oxide agglomerates further deposited on the surface of the iron oxide layer or powder of metallic iron produced by the reduction of the powder during operation, since the rotary hearth 2 is moved downward, the powder of the agglomerates and the powder of metallic iron are compressed into the porous iron oxide layer sequentially and only the thickness of the iron oxide layer is increased. Therefore, it is possible to continue operation without forming an iron plate.

The rate of descending when the rotary hearth 2 is moved downward continuously and the amount of descending when the rotary hearth 2 is moved downward intermittently may be adjusted depending on the amount of powder of the iron oxide agglomerates (hereinafter, simply referred to as "agglomerates") entering the reduction furnace. In such a case, the mass of the powder of the agglomerates entering the furnace together with the iron oxide agglomerates per unit time is determined based on the amount of the iron oxide agglomerates charged and the rate of occurrence of powder of the agglomerates. The mass of the metallic iron powder obtained by reduction is determined based on the mass of the powder of the agglomerates from the past operating performance. The mass of the metallic iron powder is converted into a volume A based on the bulk density of the metallic iron powder. On the other hand, the product of the amount of descending per unit time of the rotary hearth 2 and the area of the hearth is defined as a spatial volume B. The rotary hearth 2 is moved downward within the unit time so that the ratio A/B is 50 or less. With respect to the mixing rate of the powder of the agglomerates, the rate obtained from the past operating performance may be used.

If the ratio A/B exceeds 50, the gap between the edge of the blade of the discharge screw 4 and the surface of the rotary hearth 2 is decreased, and when an iron oxide layer is formed, the iron oxide layer is easily brought into contact with the edge of the blade of the discharge screw 4, and thereby the powder of the agglomerates is strongly compressed into the iron oxide layer. As a result, an iron plate is easily formed on the iron oxide layer. Furthermore, in order to prevent the contact between the iron oxide layer formed on the surface of the moving hearth 2 and the edge of the blade of the discharge screw 4 more reliably, the ratio A/B is preferably 20 or less.

The rate of descending (or amount of descending) of the rotary hearth 2 may be adjusted so that a gap corresponding to three-fourths or less of the average diameter of the agglomerates is provided between the edge of the blade of the discharge screw 4 and the surface of the rotary hearth 2 or the iron oxide layer. In such a way, it is also possible to prevent the powder of the agglomerates being compressed into the surface of the moving hearth or the iron oxide layer by the edge of the blade of the discharge screw 4, and thus the formation of an iron plate can be prevented. Herein, if the gap between the edge of the blade of the discharge screw 4 and the surface of the moving hearth 2 or the iron oxide layer is three-fourths or more of the average diameter of the agglomerates, it is not possible to discharge reduced iron by the discharge screw 4. The gap sufficient for passing the powder of the agglomerates is acceptable.

As described above, by adjusting the gap between the edge of the blade of the discharge screw 4 and the surface of the iron oxide layer depending on the amount of powder of the agglomerates mixed, the metallic iron powder is not compressed into the iron oxide layer to form an iron plate, and only an iron oxide layer is formed.

However, if the operation is continued while providing a gap between the edge of the blade of the discharge screw 4 and the surface of the moving hearth 2 so as not to compress the powder of the agglomerates into the surface of the moving hearth 2, the powder of the agglomerates mixed starts to form an iron oxide layer on the surface of the rotary hearth 2 and the thickness thereof increases, which may obstruct the operation. However, this iron oxide layer is porous because it is not strongly pressed by the edge of the blade of the discharge screw 4. Therefore, it is possible to scrape the iron oxide layer off easily with a cutter or the like. Additionally, since the iron oxide layer is porous, even when the iron oxide layer is separated from the surface of the moving hearth 2, the layer is separated in small lumps. Therefore, the separated iron oxide is not wound around the discharge screw 4 or does not cause clogging of the discharge port for reduced iron.

By scraping off the porous iron oxide layer formed on the surface of the rotary hearth 2 regularly, the surface of the rotary hearth 2 can be renewed regularly. In such a way, it is possible to perform continuous operation without repairing the rotary hearth 2.

Additionally, by scraping the iron oxide layer 9 off regularly with a cutter and also by chipping the surface of the moving hearth 2 within the allowable range, it is possible to remove depressions and cracks occurring on the surface of the moving hearth 2, and the maintenance period of the moving hearth 2 can be delayed. Furthermore, it is possible to obtain reduced iron of stable quality. Herein, "regularly" means at the time when continuous operation is obstructed, which depends on the scale of facilities, and operational conditions.

In this embodiment, with respect to the rotary hearth furnace, the furnace shell 1 is cap-shaped, the rotary hearth 2 is disk-shaped, and the columnar partition 3 is provided in the center thereof. However, the present invention is not necessarily limited to this, and the furnace shell may be annular and the rotary hearth may be doughnut-shaped, in the same manner as that of the conventional method.

In this embodiment, the rail 6 is fixed upside down on the lower surface of the rotary hearth 2, and the rollers 7 provided with the elevating devices 8 are provided on the ground (floor) side. However, the present invention is not necessarily limited to this, and a method may be used in which rollers or wheels are fixed on the lower surface of the rotary hearth, a rail is arranged on the ground (floor) side, and a plurality of elevating devices are provided on the lower surface of the rail so that the entire rail is moved vertically.

In this embodiment, the discharge screw axis and the through-hole are sealed with a gland packing. However, the present invention is not limited to this, and an expansion joint similar to that in Prior Art 1 may be used. In such a case, since the discharge screw axis does not move vertically and only expands horizontally, the fatigue life of the expansion joint is sufficiently long, and the maintenance workload due to the replacement of the expansion joint can be reduced.

We claim:

1. A movable-hearth heating furnace comprising:

a heating furnace;

a movable hearth onto which a metal oxide-containing material may be placed, wherein said movable hearth is mounted in said heating furnace for substantially horizontal movement and for controlled substantially vertical movement; and a discharger for discharging the heat-treated material from said heating furnace.

2. The movable-hearth heating furnace according to claim 1, further comprising an elevating device for moving said movable hearth vertically, said elevating device being provided on a supporting section for supporting said movable hearth.

3. The movable-hearth heating furnace according to claim 1, further comprising a seal plate provided around said entire lower section of said movable hearth and a water-sealing trough fixed on a side wall of said heating furnace, wherein the length of said seal plate and the depth and fixing position of said water-sealing trough are determined so that the lower end of said seal plate is kept being immersed in water in said water-sealing trough when said movable hearth is moved upward to the upper limit.

4. The movable-hearth heating furnace according to claim 1, further comprising a columnar partition provided on said movable hearth and a roof having a recess, wherein the top of said columnar partition is inserted into said recess and the height of said columnar partition and the depth of said recess are determined so that the top of said columnar partition does not come out of said recess when said movable hearth is moved downward to the lower limit.

5. A method for making reduced metal agglomerates using a movable hearth heating furnace which comprises a heating furnace, a movable hearth in said heating furnace, and a discharger for discharging a material from said heating furnace provided above and in close proximity to said movable hearth, said method comprising the steps of:

feeding metal oxide agglomerates containing a carbonaceous material onto said movable hearth;

heating and reducing the metal oxide agglomerates to produce reduced metal agglomerates while said movable hearth is moving in said heating furnace; and discharging the reduced metal agglomerates from said heating furnace by said discharger, wherein said movable hearth is continuously or intermittently moved vertically depending on the thickness of a metal oxide layer formed by the deposition of powder of the metal oxide agglomerates mixed into said heating furnace together with the metal oxide agglomerates so that a gap is provided between the surface of the metal oxide layer and said discharger during operation.

6. The method for making reduced metal agglomerates according to claim 5, wherein the rate of moving said movable hearth downward continuously or the amount of moving said movable hearth downward intermittently is adjusted depending on the amount of powder of the metal oxide agglomerates entering said heating furnace.

7. The method for making reduced metal agglomerates according to claim 5, wherein the rate of moving said movable hearth downward is adjusted so that a gap corresponding to three-fourths or less of the average diameter of the agglomerates is provided between the edge of a blade of a discharge screw of said discharger and the surface of said movable hearth or the iron oxide layer.

* * * * *

UNITED STATES PATENT AND TRADEMARK OFFICE

CERTIFICATE OF CORRECTION

PATENT NO. : 6,790,255 B2
DATED : September 14, 2004
INVENTOR(S) : Hashimoto et al.

It is certified that error appears in the above-identified patent and that said Letters Patent is hereby corrected as shown below:

Title page,
Item [73] Assignee, should read:

-- [73] Kabushiki Kaisha Kobe Seiko Sho
(Kobe Steel, Ltd.), Kobe (JP) --

Signed and Sealed this

Seventh Day of December, 2004

JON W. DUDAS
*Director of the United States Patent and Trademark Office*